US008324996B2

(12) United States Patent
McGuire

(10) Patent No.: US 8,324,996 B2
(45) Date of Patent: Dec. 4, 2012

(54) PRINTED CIRCUIT BOARD EMBEDDED RELAY

(76) Inventor: Patrick L. McGuire, Oakland, CA (US)

( * ) Notice: Subject to any disclaimer, the term of this patent is extended or adjusted under 35 U.S.C. 154(b) by 0 days.

(21) Appl. No.: 13/193,093

(22) Filed: Jul. 28, 2011

(65) Prior Publication Data

US 2012/0025934 A1 Feb. 2, 2012

Related U.S. Application Data

(60) Provisional application No. 61/368,411, filed on Jul. 28, 2010.

(51) Int. Cl.
*H01H 3/00* (2006.01)

(52) U.S. Cl. ..... 335/177; 335/78

(58) Field of Classification Search ..... 335/177
See application file for complete search history.

(56) References Cited

U.S. PATENT DOCUMENTS 4,000,381 A * 12/1976 Plice et al. ..... 381/418
5,809,157 A * 9/1998 Grumazescu ..... 381/412
5,921,382 A * 7/1999 Retter ..... 200/514
7,728,242 B2 * 6/2010 Huang ..... 200/341
8,143,978 B2 * 3/2012 Shen ..... 335/80
2002/0109568 A1 8/2002 Wohlfarth
2004/0244191 A1 12/2004 Orr et al.
2006/0001512 A1 * 1/2006 Garcia et al. ..... 335/205
2010/0182110 A1 7/2010 Shen

OTHER PUBLICATIONS

International Search Report and Written Opinion dated Mar. 28, 2012 from corresponding International Patent Application No. PCT/US2011/045751—8 pages.

* cited by examiner

*Primary Examiner* — Elvin G Enad
*Assistant Examiner* — Lisa Homza
(74) *Attorney, Agent, or Firm* — Maier & Maier PLLC

(57) ABSTRACT

According to one exemplary embodiment, an electromechanical relay may be described. The relay can be constructed using printed circuit board (PCB) construction, and can have at least a pair of coils, for example one on the top of or above the PCB, the other on the bottom of or below the PCB, at least two ferromagnetic cores, one of which can be set at the center of each coil, at least a set of contacts which can be on the surface of the printed circuit board, a spacer which can be set between the coils, and a magnet which can be set within the spacer.

8 Claims, 5 Drawing Sheets

PRINTED CIRCUIT BOARD EMBEDDED RELAY

CROSS-REFERENCE TO RELATED APPLICATIONS

This application claims the benefit of U.S. Provisional Patent Application No. 61/368,411, filed on Jul. 28, 2010, and entitled, "Printed Circuit Board Embedded Relay", the contents of which are incorporated herein by reference.

BACKGROUND

A relay is a switch which is operated electromechanically. One common example of a relay consists of an electromagnet, an armature that is held in place by a spring, and a set of electrical contacts. When the electromagnet is energized, it attracts the armature, pulling it into the contacts, completing an electrical circuit. When current is no longer supplied to the electromagnet, the spring pushes the armature away from the contacts, breaking the circuit. Relays are useful in that they provide isolation between a controlling circuit and the circuit being controlled. This allows, for instance, a low-power circuit to safely control a high-power circuit, or to control several circuits at once.

Typically, relays are relatively large discrete components that must be attached individually to printed circuit boards (PCBs), which can be expensive and cumbersome.

SUMMARY

According to one exemplary embodiment, an electromechanical relay may be described. The relay can be constructed using printed circuit board (PCB) construction, and can have at least a pair of coils, for example one on the top of or above the PCB, the other on the bottom of or below the PCB, at least two ferromagnetic cores, one of which can be set at the center of each coil, at least a set of contacts which can be on the surface of the printed circuit board, a spacer which can be set between the coils, and a magnet which can be set within the spacer.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION

Aspects of the present invention are disclosed in the following description and related figures directed to specific embodiments of the invention. Those skilled in the art will recognize that alternate embodiments may be devised without departing from the spirit or the scope of the claims.

Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Generally referring to FIGS. 1-5, an electromechanical relay that is built using printed circuit board construction is shown. The relay can be built by itself, in a switching array with other similar relays, or embedded within a printed circuit board (PCB) accompanied by other electronic components.

Figure 1:
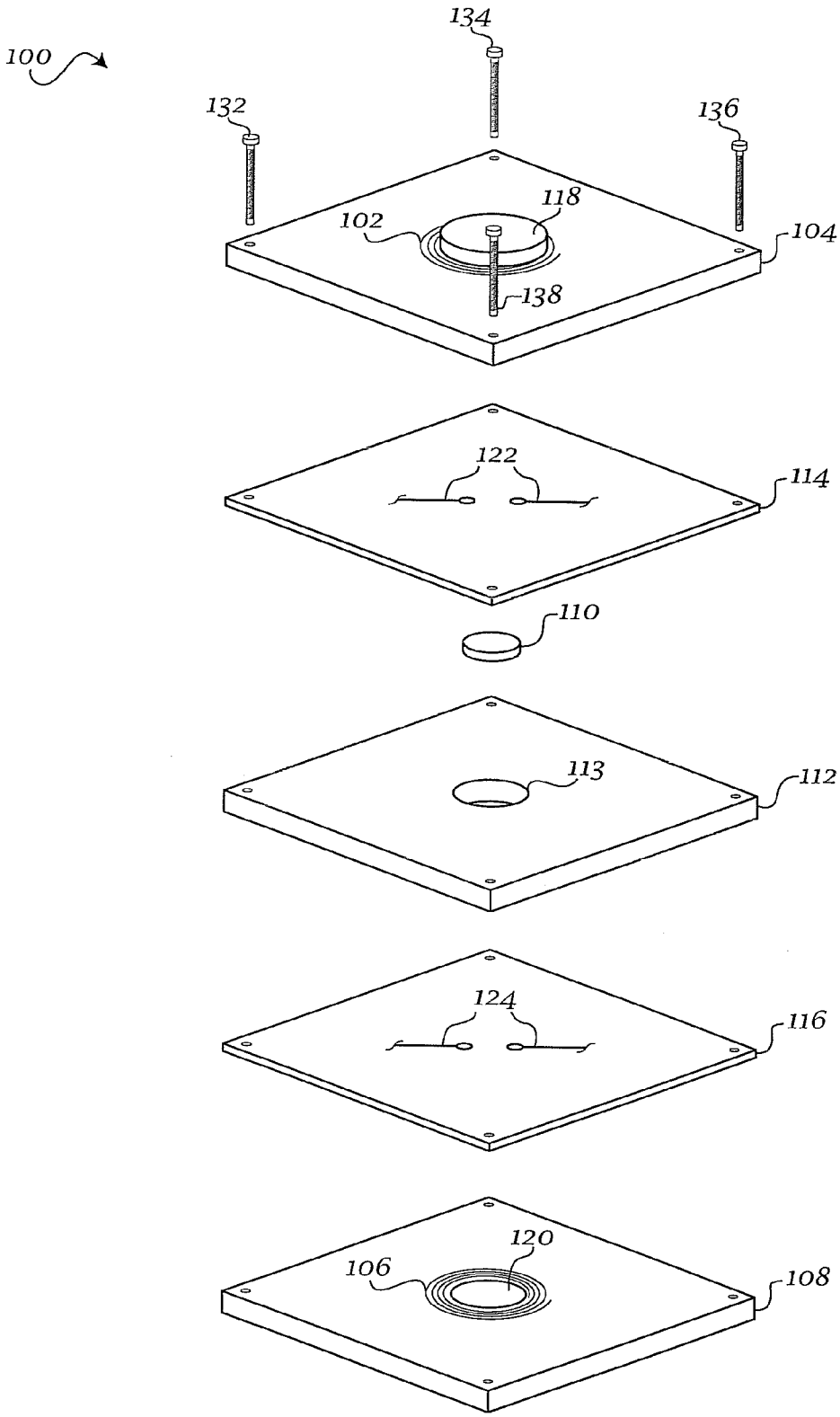
FIG. 1 is an exploded view of an exemplary embodiment of a relay device.

In FIG. 1, an exemplary embodiment of a relay device 100 can be shown. Relay device 100 may include coil 102, which can be contained in coil layer 104, and coil 106, which can be contained in coil layer 108. Coil 102 and coil 106 can be wired in series, in parallel, or operated independently, for example, at different current levels or energized in time in a staggered manner Coil layer 104 and coil layer 108 can contain one or more sublayers in a manner of accommodating the windings of coil 102 and coil 106 respectively. Coil layer 104 and coil layer 108 can be constructed in such a way that the central via, or through-connection, that passes through each sublayer may only connect one sublayer with the next. Coil layer 104 and coil layer 108 can further be constructed so that more than one sublayer is laminated together in such a way that epoxy resin or other pre-impregnated composite flows over the edges of the central hole, which can insulate vias above one another from each other.

A magnet 110 can be located between coil 102 and coil 106. Magnet 110 can be cylindrical in shape and can be polarized along its axis. Magnet 110 can be coated in a conductive material, for example gold, which can facilitate electrical conduction. Magnet 110 can be contained within a spacer 112. Additionally, magnet 110 can be any size or shape, as desired. In one exemplary embodiment, magnet 110 can be between about 1.5 mm and 1.6 mm in diameter and between about 0.7 mm and 0.8 mm in length.

Spacer 112 can be a layer of PCB material void of copper, which can contain a bore, hole or space 113. Additionally, spacer can be any size or shape, for example between about 1.5 mm and about 1.6 mm thick. Bore 113 can be sized in such a way that magnet 110 can be contained inside with little freedom of movement laterally but some freedom of movement along its axis.

Disposed between coil layer 104 and spacer 112 may be contact layer 114. Contact layer 114 can be constructed so as to contain an electrical contact structure 122 positioned in such a way that a circuit is closed when magnet 110 is positioned proximate to it. Disposed between coil layer 108 and spacer 112 may be contact layer 116. Contact layer 116 can be constructed so as to contain an electrical contact structure 124 positioned in such a way that a circuit is closed when magnet 110 is positioned proximate to it.

The thickness of spacer 112 can be greater than the thickness of magnet 110 so that magnet 110 can move within hole 213 in spacer 112 to touch either contact layer 114 or contact layer 116. For example, if spacer 112 is about 1.6 mm thick and magnet 110 is about 1.6 mm in diameter and about 0.8 mm in length, magnet 110 can be able to move with a stroke of about 0.8 mm within spacer 112.

A ferromagnetic core 118 can be located inside coil 102, and can be secured in place within coil layer 104 by glue, epoxy resin, or any other fastener. A similar core 120 can be located inside coil 106, and can be similarly secured within coil layer 108. Core 118 and core 120 can be made of steel, iron, or other similar material as desired and as known in the art. Core 118 can be positioned so that when it attracts magnet 110, magnet 110 can be held in place against contact layer 114. Similarly, core 120 can be positioned so that when it attracts magnet 110, magnet 110 can be held in place against contact layer 116.

Coil layer 104, spacer 112, and coil layer 108, as well as contact layers 114 and 116, can be fastened together through the use of screw 132, screw 134, screw 136, and screw 138. Alternatively, they can be secured with glue, epoxy resin, or in any other manner known in the art. For example, where it may be desirable to form a relay device, such as relay device 100, in a compact fashion, an epoxy or other known adhesive may be used to couple coil layer 104, spacer 112 and coil layer 108, as well as contact layers 114 and 116. However, it should be appreciated that different orientations, layouts, constructions and sizes of exemplary relay device 100 may be utilized as desired.

Figure 2:
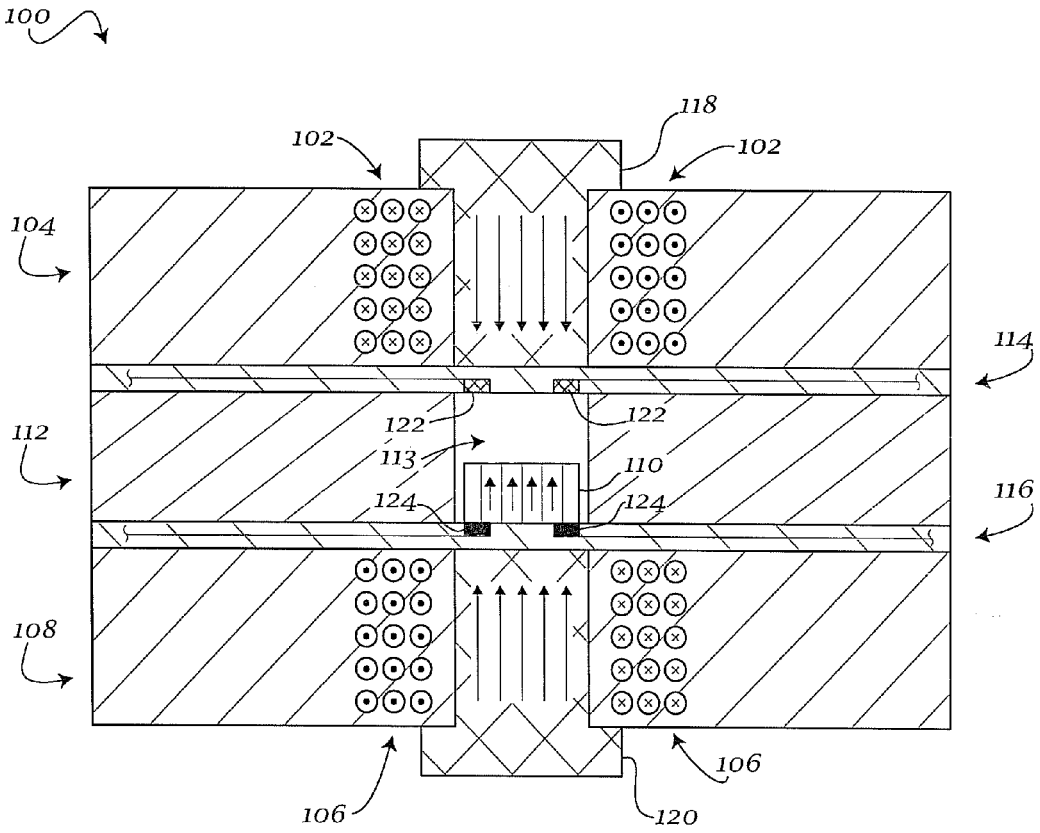
FIG. 2 is an cross-sectional view of an exemplary embodiment of a relay device in a first position.
Figure 3:
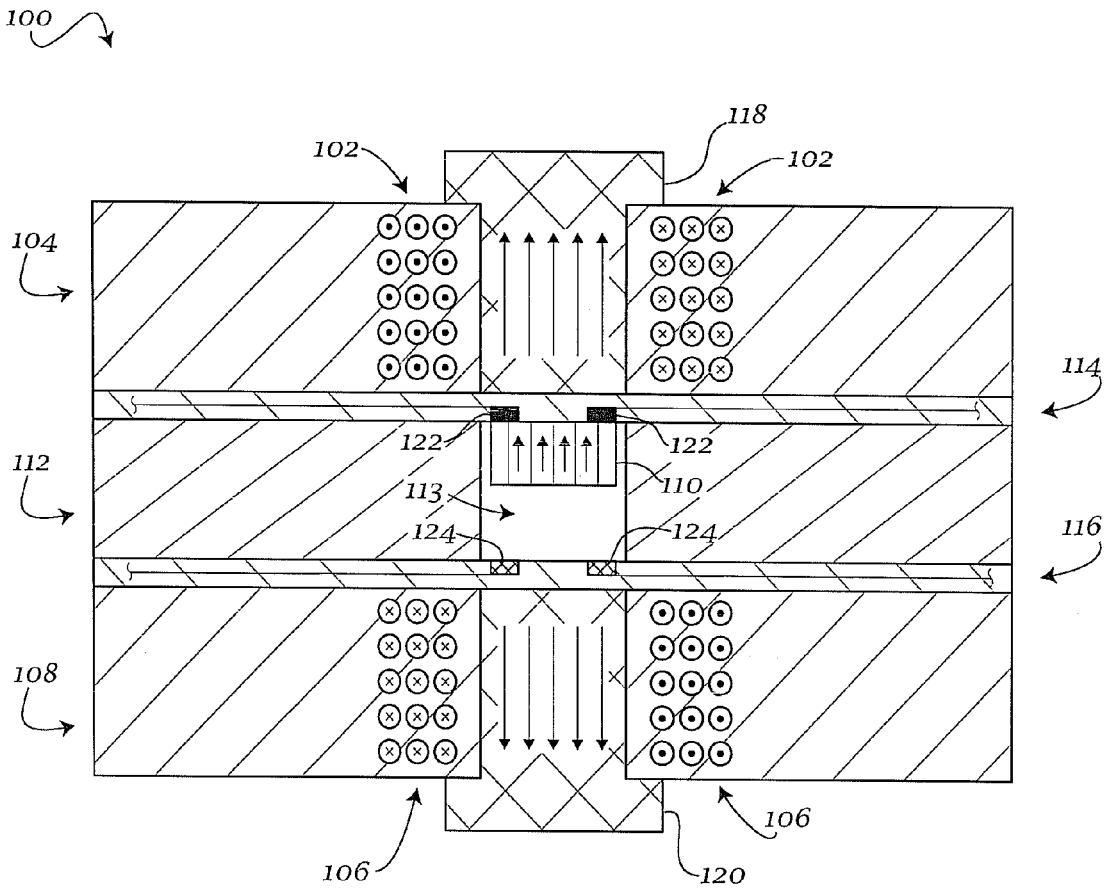
FIG. 3 is an cross-sectional view of an exemplary embodiment of a relay device in a second position.

Turning to FIGS. 2-3, relay device 100 can operate in the following manner, although other manners of implementation may be utilized as desired. As relay 100 may be bi-stable, a current pulse can be used to set the relay 100 and a pulse of opposite polarity may reset the relay 100. Therefore, coil 102 and coil 106 can be oriented so that when energized, the same magnetic polarity faces inward from each of coil 102 and coil 106, respectively, toward magnet 110. Then magnet 110 can be simultaneously attracted to one coil and repelled from the other. For example, if magnet 110 is attracted to coil 102, it can then be held in place by core 118 against contact layer 114. Magnet 110 can then form an electrically conductive bridge across the contacts 122, which may be gold plated, located on contact layer 114, completing a circuit. If the polarity of the current pulse is reversed, magnet 110 can be pushed away from coil 102 and may be pulled toward coil 106, and then may be held in place by core 120 against contact layer 116. Magnet 110 can then form an electrically conductive bridge across the contacts 124 located on contact layer 116, for example, completing a different circuit.

In further exemplary embodiments, relay device 100 may be used in any manner desired. For example, relay device 100 may be used as a switching device. In other exemplary embodiments, relay device 100 may be used with any number of other relay devices, for example in a switching array with, for example, other similar relays. Additionally, relay device 100 may be embedded within a PCB and can be accompanied by any number of additional electronic components.

Figure 4:
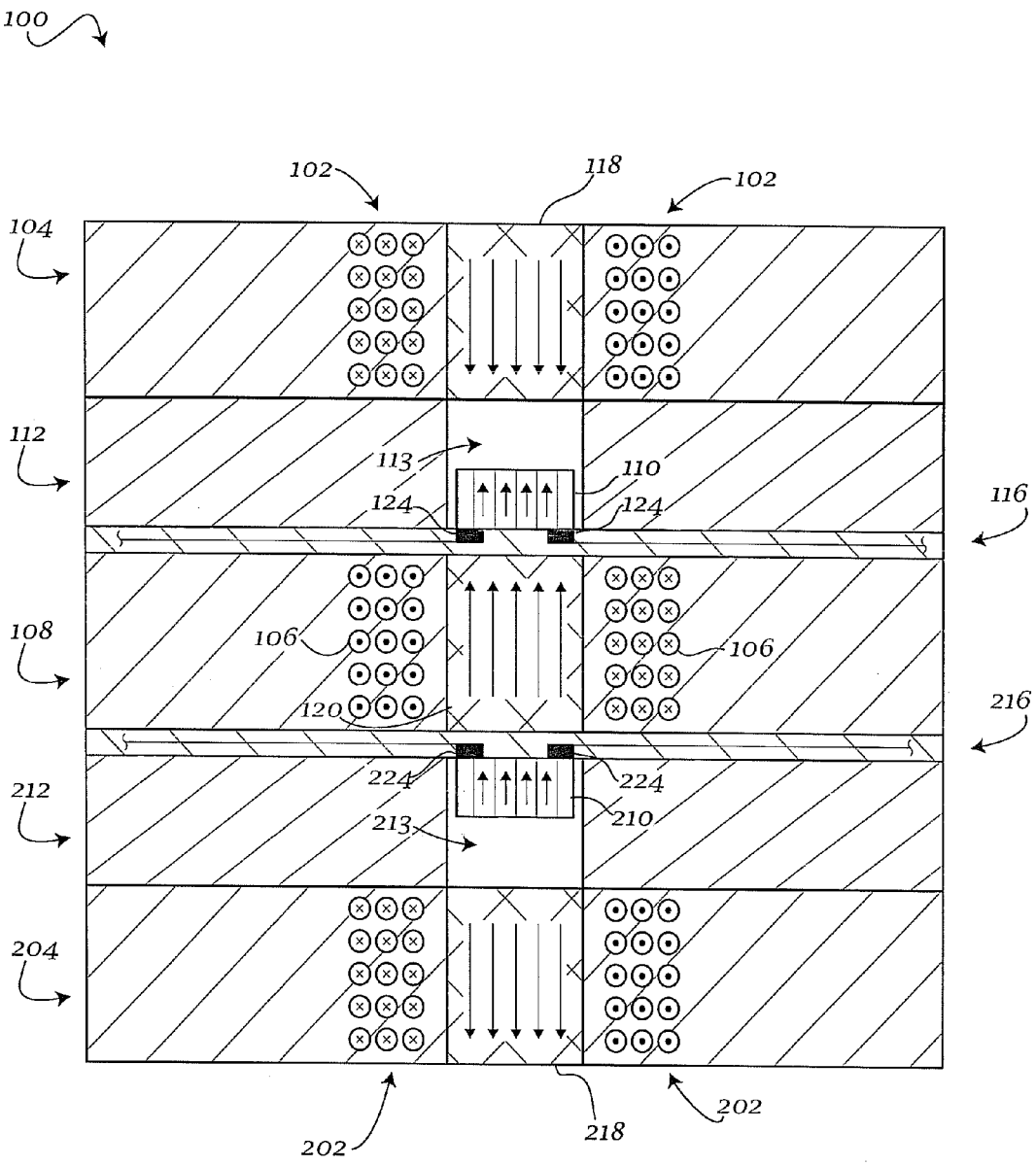
FIG. 4 is an cross-sectional view of a second exemplary embodiment of a relay device in a first position.
Figure 5:
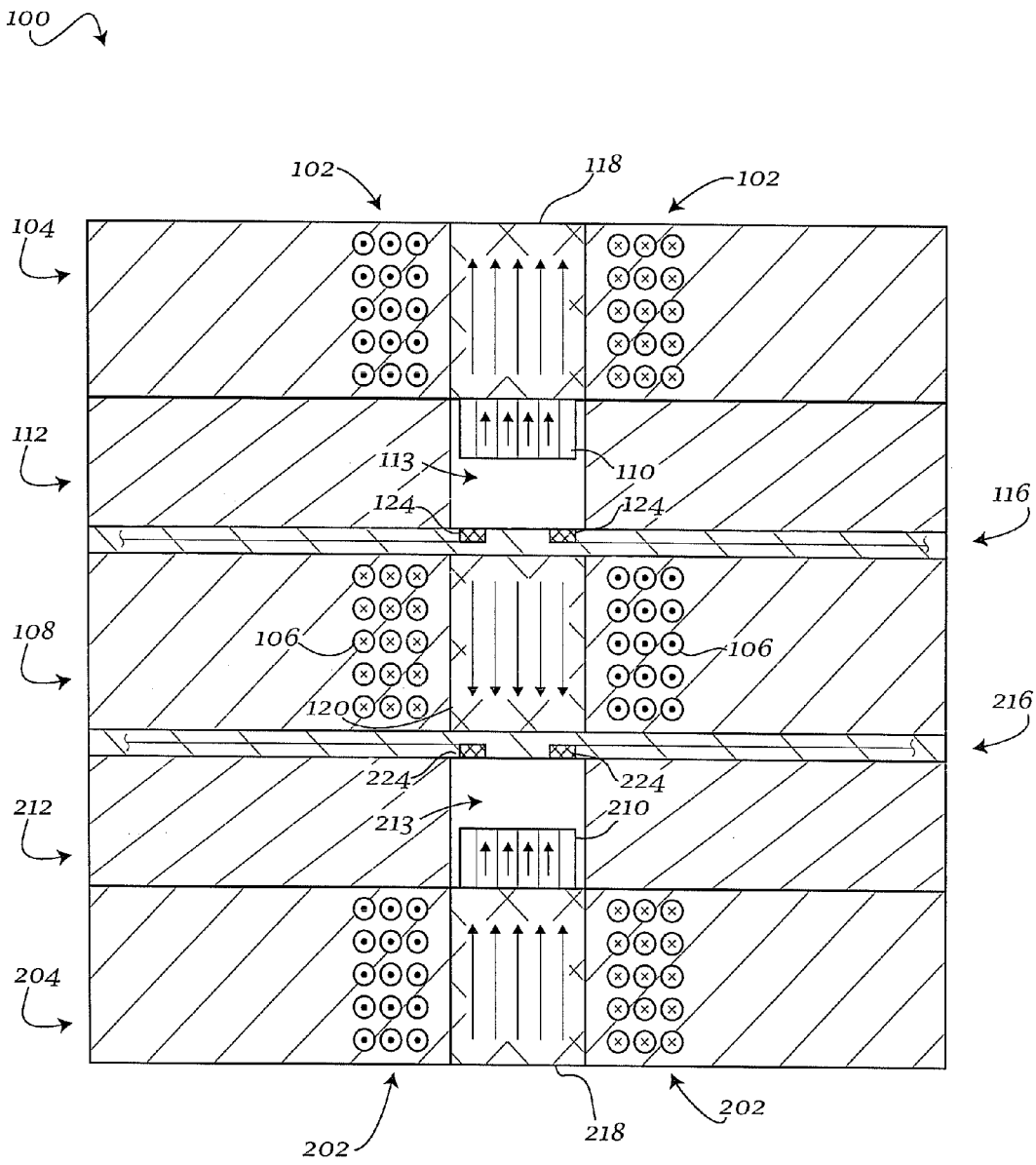
FIG. 5 is an cross-sectional view of a second exemplary embodiment of a relay device in a second position.

Turning to FIGS. 4-5, another exemplary embodiment of a relay device 200 can be disclosed. Relay device 200 can include most of the components of relay device 100, which are referenced with identical numerals and can be understood to have substantially the same functionality.

Relay device 200 may further include a coil 202, which can be contained in coil layer 204. Coils 102, 106 and 202 can be wired in series, in parallel, or operated independently, for example, at different current levels or energized in time in a staggered manner.

Coil layer 204 can contain one or more sublayers in a manner of accommodating the windings of coil 202. Coil layer 204 can be constructed in such a way that the central via, or through-connection, that passes through each sublayer may only connect one sublayer with the next. Coil layer 204 can further be constructed so that more than one sublayer is laminated together in such a way that epoxy resin or other pre-impregnated composite flows over the edges of the central hole, which can insulate vias located above one another from each other.

A magnet 210 can be located between coil 202 and coil 106. Magnet 210 can be cylindrical in shape and can be polarized along its axis. Magnet 210 can be coated in a conductive material, for example gold, which can facilitate electrical conduction. Magnet 210 can be contained within a spacer 212. Additionally, magnet 210 can be any size or shape, as desired. In one exemplary embodiment, magnet 210 can be between about 1.5 mm and about 1.6 mm in diameter and between about 0.7 mm and about 0.8 mm in length.

Spacer 212 can be a layer of PCB material void of copper, which can contain a bore, hole or space 213. Additionally, spacer 212 can be any size or shape, for example between about 1.5 mm and about 1.6 mm thick. Bore 213 can be sized in such a way that magnet 210 can be contained inside with little freedom of movement laterally but some freedom of movement along its axis.

Disposed between coil layer 108 and spacer 112 may be contact layer 116. Contact layer 116 can be constructed so as to contain an electrical contact structure 124 positioned in such a way that a circuit is closed when magnet 110 is positioned proximate to it. Disposed between coil layer 108 and spacer 212 may be contact layer 216. Contact layer 216 can be constructed so as to contain an electrical contact structure 224 positioned in such a way that a circuit is closed when magnet 210 is positioned proximate to it. It should be noted that the embodiment of relay device 200 does not include a contact layer 114 disposed between coil layer 104 and spacer 112, nor is any contact layer disposed between coil layer 204 and spacer 212. Therefore, magnet 110 can move within hole 113 in spacer 112 to touch either core 118 or contact layer 116.

The thickness of spacer 212 can be greater than the thickness of magnet 210 so that magnet 210 can move within hole 213 in spacer 212 to touch either core 218 or contact layer 216. For example, if spacer 212 is about 1.6 mm thick and magnet 210 is about 1.6 mm in diameter and about 0.8 mm in length, magnet 210 can be able to move with a stroke of about 0 8 mm within spacer 212.

A ferromagnetic core 218 can be located inside coil 202, and can be secured in place within coil layer 204 by glue, epoxy resin, or any other fastener. Core 218 can be made of steel, iron, or other similar material as desired and as known in the art. Core 218 can be positioned so that when it attracts magnet 210, magnet 210 can be held in place against core 218. Similarly, core 120 can be positioned so that when it attracts magnet 210, magnet 210 can be held in place against contact layer 216.

Fastening of coil layer 204, spacer 212, as well as contact layer 216 can be achieved in any desired manner, including, but not limited to, as described above for the embodiment of relay 100.

Relay device 200 can operate in the following manner, as shown in FIGS. 4-5, although other manners of implementation may be utilized as desired. As relay 200 may be bi-stable, a current pulse can be used to set the relay 200 and a pulse of opposite polarity may reset the relay 200. Therefore, coil 102 and coil 106 can be oriented so that when energized, the same magnetic polarity faces inward from each of coil 102 and coil 106, respectively, toward magnet 110. Similarly, coil 202 may be oriented so that when energized, the same magnetic polarity faces inward from each of coil 202 and coil 106, respectively, toward magnet 210. Then magnets 110, 210 can be simultaneously attracted to one coil of the corresponding pair of coils and repelled from the other. In other words, coils 102 and 202 may be oriented such that, when energized, the magnetic polarities generated by coils 102 and 202 are oriented in the same direction, while the magnetic polarity of coil 106 is oriented in a direction opposite to that of coils 102 and 202.

For example, if magnet 110 is attracted to coil 102, it can then be held in place by core 118 against core 118. Simultaneously, magnet 210 may be attracted to coil 202, and can then be held in place by core 218 against core 218. In this configuration, magnet 110, 210 do not bridge any circuits.

If the polarity of the current pulse is reversed, magnet 110 can be pushed away from coil 102 and may be pulled toward coil 106, and then may be held in place by core 120 against contact layer 116. Simultaneously, magnet 210 can be pushed away from coil 202 and may be pulled toward coil 106, and then may be held in place by core 120 against contact layer 216. Magnet 110 can then form an electrically conductive bridge across the contacts 124, which may be gold plated, located on contact layer 116, for example, completing a first circuit, while magnet 210 can then form an electrically conductive bridge across the contacts 224, which may be gold plated, located on contact layer 216, for example, completing a second circuit.

It should be appreciated that the embodiment of relay 200 is not limited to solely three coil layers, two contact layers, two spacers and two magnets. Additional layer groups may be added as desired. For example, another exemplary embodiment of relay 200 may include five coil layers, four contact layers, four spacers and four magnets.

In a further exemplary embodiment of the above, if alternate side contacts of relay devices 100, 200 are not used for switching signals, they may be used to monitor a switching state of the relay devices 100, 200.

In other exemplary embodiments, relay devices 100, 200 may be utilized in systems that have a need for many interconnected relays and where the interconnected relays may be desired to be formed on a single PCB. This may allow for a decrease in manufacturing expenses as the number of PCBs which are utilized may be decreased.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A PCB-embedded relay, comprising:

at least one pair of coils, one coil of the pair of coils being disposed above the PCB, the other coil of the pair of coils disposed below the PCB;

at least one pair of ferromagnetic cores, each ferromagnetic core being disposed between the center of each coil of the pair of coils;

a spacer, disposed between the at least one pair of coils and having a bore defined therein, the bore extending between the pair of ferromagnetic cores;

a permanent magnet disposed within the bore and movable from a first location proximate one of the ferromagnetic cores and a second location proximate the other of the ferromagnetic cores;

a first set of contacts disposed between the magnet and one ferromagnetic core of the pair ferromagnetic cores; and a second set of contacts disposed between the magnet and the other ferromagnetic core of the pair of ferromagnetic cores.

2. The relay of claim 1, wherein one coil of the pair of coils is wound in a direction opposite the other coil of the pair of coils.

3. The relay of claim 1, wherein the permanent magnet is gold-plated.

4. The relay of claim 1, wherein the permanent magnet has a diameter of between about 1.5 mm and about 1.6 mm and a length of between about 0.7 mm and about 0.8 mm.

5. The relay of claim 1, wherein the relay is bi-stable.

6. The relay of claim 1, wherein the first coil and the second coil are wired in series.

7. The relay of claim 1, wherein the first coil and the second coil are wired in parallel.

8. The relay of claim 1, wherein the first coil and the second coil are operated independently.

* * * * *